US007712268B1

(12) United States Patent
Guthrie

(10) Patent No.: US 7,712,268 B1
(45) Date of Patent: May 11, 2010

(54) SCREEN-TYPE STORM BARRIER AND WIND ABATEMENT SYSTEM

(76) Inventor: William Guthrie, 4625 Island Reef Dr., Wellington, FL (US) 33467

( * ) Notice: Subject to any disclaimer, the term of this patent is extended or adjusted under 35 U.S.C. 154(b) by 16 days.

(21) Appl. No.: 11/487,222

(22) Filed: Jul. 14, 2006

Related U.S. Application Data

(60) Provisional application No. 60/699,126, filed on Jul. 14, 2005.

(51) Int. Cl.
*E06B 3/26* (2006.01)
*E04B 1/00* (2006.01)

(52) U.S. Cl. ..... 52/202; 52/222; 52/506.02

(58) Field of Classification Search ..... 52/202, 52/222, 506.02; 160/371, 379, 380; 49/61
See application file for complete search history.

(56) References Cited

U.S. PATENT DOCUMENTS 1,602,096 A * 10/1926 Barnes ..... 160/128
3,696,857 A * 10/1972 Le Tarte ..... 160/371
4,006,768 A * 2/1977 Horgan, Jr. ..... 160/136
4,333,284 A * 6/1982 Meadows ..... 52/222
4,878,314 A * 11/1989 Blockinger ..... 49/381
6,125,910 A * 10/2000 Pepperell et al. ..... 160/371
6,230,455 B1 * 5/2001 Arehart et al. ..... 52/202
6,263,949 B1 * 7/2001 Guthrie, Jr. ..... 160/380
6,314,690 B1 * 11/2001 Lilie et al. ..... 52/204.61
6,378,267 B1 * 4/2002 Bass ..... 52/656.7
6,505,669 B2 * 1/2003 Lilie et al. ..... 160/371
6,880,612 B2 * 4/2005 Pylkki et al. ..... 160/371
7,302,986 B2 * 12/2007 Flack et al. ..... 160/89

* cited by examiner

*Primary Examiner*—Richard E Chilcot, Jr.
*Assistant Examiner*—Mark R Wendell
(74) *Attorney, Agent, or Firm*—Mark D. Bowen, Esq.; Malin Haley DiMaggio Bowen & Lhota, P.A.

(57) ABSTRACT

A screen-type wind abatement system is provided for protecting openings, such as window and door openings, in buildings and other structures. Both openable and non-openable systems are disclosed. A openable system includes a first frame member anchored to the structure wall, a second frame member pivotally connected to the first frame member and having a screen mounting portion for receiving an edge of a screen and a retainer, and a snap-lock mechanism for removably connecting the first and second frame members, whereby the screen is sandwiched between the second frame and the retainer in covering relation with a window or door opening. The assembly is of heavy-duty construction to resist high impact forces caused by hurricane force winds and accompanying flying debris. The snap-lock mechanism allows for quick and simple installation and removal the second frame member. A fixed system is disclosed for non-openable installations.

8 Claims, 7 Drawing Sheets

SCREEN-TYPE STORM BARRIER AND WIND ABATEMENT SYSTEM

CROSS REFERENCE TO RELATED APPLICATIONS

This application claims the benefit of provisional U.S. Patent Application Ser. No. 60/699,126, filed on Jul. 14, 2005.

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office patent file or records, but otherwise reserves all copyrights rights whatsoever.

BACKGROUND OF THE INVENTION

1. Field of the Invention

The present invention relates to a screen-type storm barrier system for covering openings such as windows and doors. More particularly, the present invention relates to a heavy-duty screen assembly that is resistant to hurricane force winds and associated flying debris, burglars and vandals.

2. Description of Related Art

Over the past 20 years the United States has experienced numerous weather-related disasters each of which caused in excess of $1 billion in damages. In 2004, the State of Florida was subjected to direct hits from multiple hurricanes the combined effect of which resulted in damages of approximately 20 billion dollars.

In addition, population growth along the coastline of the United States has resulted in an increased risk to life and property from hurricane related damage. There are approximately 40 million permanent residents along the hurricane-prone coastline of the United States, with areas such as Texas, Florida, and the Carolinas, where hurricanes frequently strike, experiencing rapid population growth. Furthermore, many coastal areas experience substantial but temporary population increases from holiday, weekend, and vacation visitors during hurricane season.

Homes, buildings, and other structures, suffer substantial damage when storm generated winds carrying windborne debris penetrate the structures through window and door openings. Hurricane shutters have long been used as barriers to protect window and door openings from the effects of storm generated winds. Equipping homes and other buildings with hurricane protection in the form of storm shutters is one of the most prudent actions one can take to protect life and property.

Accordingly, the background art reveals a number of storm shutters and other devices designed for permanent or removable installation on homes and buildings. Conventional storm shutters typically consist of corrugated metal panels affixed to the outside of a given structure. For example, U.S. Pat. No. 2,878,536, issued to Becker, discloses a shutter structure having overlapping corrugated panels. U.S. Pat. No. 4,333,271, issued to DePaolo et al., discloses a hurricane panel system for covering windows and doors wherein a plurality of corrugated metal panels are arranged in overlapping relationship to provide a protective structure. U.S. Pat. No. 5,345,716, issued to Caplan, discloses a storm shutter system comprising a combination of individual, interlocking modular elements. U.S. Pat. No. 5,852,903, issued to Astrizky, discloses a hurricane shutter comprising a pair of normally open doors that are swingable to a closed position. U.S. Pat. No. 5,911,660, issued to Watson, discloses a storm panel comprising a plurality of interlocking tiles interlocked together by a plurality of dovetail joints.

A significant disadvantage with conventional storm shutter panels is that installation is difficult and time consuming. In addition, installing panels over all of the window openings prevents light from entering the structure thereby darkening the interior. Accordingly, if power is lost, as often happens during severe storms, the occupants of the structure find themselves in total darkness.

A number of references disclosed in the background art reveal attempts to provide storm shutters that provide sufficient impact resistance while allowing light to enter to building. For example, U.S. Pat. No. 5,918,430, issued to Rowland, discloses a removable storm shield comprising transparent convex panels. U.S. Pat. No. 5,996,292, issued to Hill et al., discloses a perforated shutter system wherein at least one panel is formed of corrugations. U.S. Pat. No. 3,358,408, issued to Cooper et al., discloses an insulated light transmitting panel construction having corrugations in the side edges thereof. U.S. Pat. No. 4,685,261, issued to Seaquist, discloses a removable translucent storm shutter consisting of a ½" thick polycarbonate sheet in an aluminum channel frame. U.S. Pat. No. 5,595,233, issued to Gower, discloses hurricane shutters formed of transparent, double-skinned panels that are strengthened by rods extending through the end channels. U.S. Pat. No. 5,457,921, issued to Kostrzecha, discloses a storm shutter wherein a plurality of corrugated shatter-resistant and transparent plastic sheets fastened to the structure using a mounting mechanism and fasteners inserted through key-way slots.

The present inventor has contributed to the field of screen-type wind abatement systems for windows and doors. U.S. Pat. No. 6,263,949, issued to Guthrie (the present inventor), discloses a screen system for covering openings such as windows and doors includes a frame having a screen-mounting portion for receiving an edge of a screen and a retainer bar. The screen is sandwiched between the frame and the retainer bar and the assembly is of heavy-duty constriction to resist high impact forces caused by hurricane force winds and accompanying flying debris. The retainer bar and frame can include one or more barbs to assist in capturing the screen and resisting forces. The retainer bar is also designed to pivot during assembly to tightly draw the screen across the opening in the frame. U.S. Pat. No. 6,263,949, is incorporated herein in its entirety by reference.

The prior art, however, fails to disclose a screen-type wind abatement system having both the strength to protect window and door openings from high winds and wind-borne debris, while also being easy to install and remove, as well as being aesthetically pleasing. Accordingly, there exists a need for a screen-type wind abatement system capable of withstanding hurricane force winds while also being light-weight and easy to install and remove.

BRIEF SUMMARY OF THE INVENTION

A screen-type wind abatement system for covering openings such as windows and doors according to the present invention is provided in a first embodiment wherein the system is removable or openable, and in a second embodiment wherein the system is permanently anchored to a structure in covering relation with a window opening. The system may be affixed directly to the structure (e.g. wall) or fastened directly to the window or door frame.

In the first removable embodiment, the system generally includes a mounting frame member anchored to the structure wall, a screen mounting member for receiving an edge of a screen pivotally connected to the mounting frame member, a retainer member for securing the screen, a metal screen having edges sandwiched between the screen mounting member and the retainer member, and a snap-fit cover for concealing fasteners used to connect the retainer member to the first frame member, and a snap lock mechanism for locking the first frame member in a closed configuration.

In the second embodiment, the system generally includes a mounting frame member, having a screen receiving portion for receiving an edge of a screen, anchored to the structure wall, window frame, or door frame, a retainer member for securing the screen, a metal screen having edges sandwiched between the first frame member and retainer member, and a snap-fit cover for concealing fasteners used to connect the retainer member to the first frame member. Both embodiments are of heavy-duty construction to resist high impact forces caused by hurricane force winds and accompanying flying debris. The snap-lock mechanism allows for quick and simple installation and removal the screen mounting member. The retainer preferably has a generally U-shaped cross-section including a cross member connected between first and second laterally spaced apart legs. A fastener cover is also contemplated to be mounted to the retainer bar for improved aesthetics.

Accordingly, the present invention provides a heavy-duty screen that can resist hurricane force winds and associated flying debris. For example, the screen of the present invention can resist the force of a two-by-four stud of lumber propelled at the screen at a force comparable to that which would be encountered under hurricane wind conditions. The screen of the present invention is designed to always be in position to cover and protect a window or door and eliminates the need for timely user intervention as discussed in the background section above. Still further, the present invention provides improved aesthetics for year round use and utilizes stainless steel to prevent corrosion that is typically encountered in coastal locations near an ocean where hurricanes commonly prevail. The screen system also protects against insects and vandals.

In accordance with these and other objects, which will become apparent hereinafter, the instant invention will now be described with particular reference to the accompanying drawings.

DETAILED DESCRIPTION OF THE INVENTION

Figure 1:
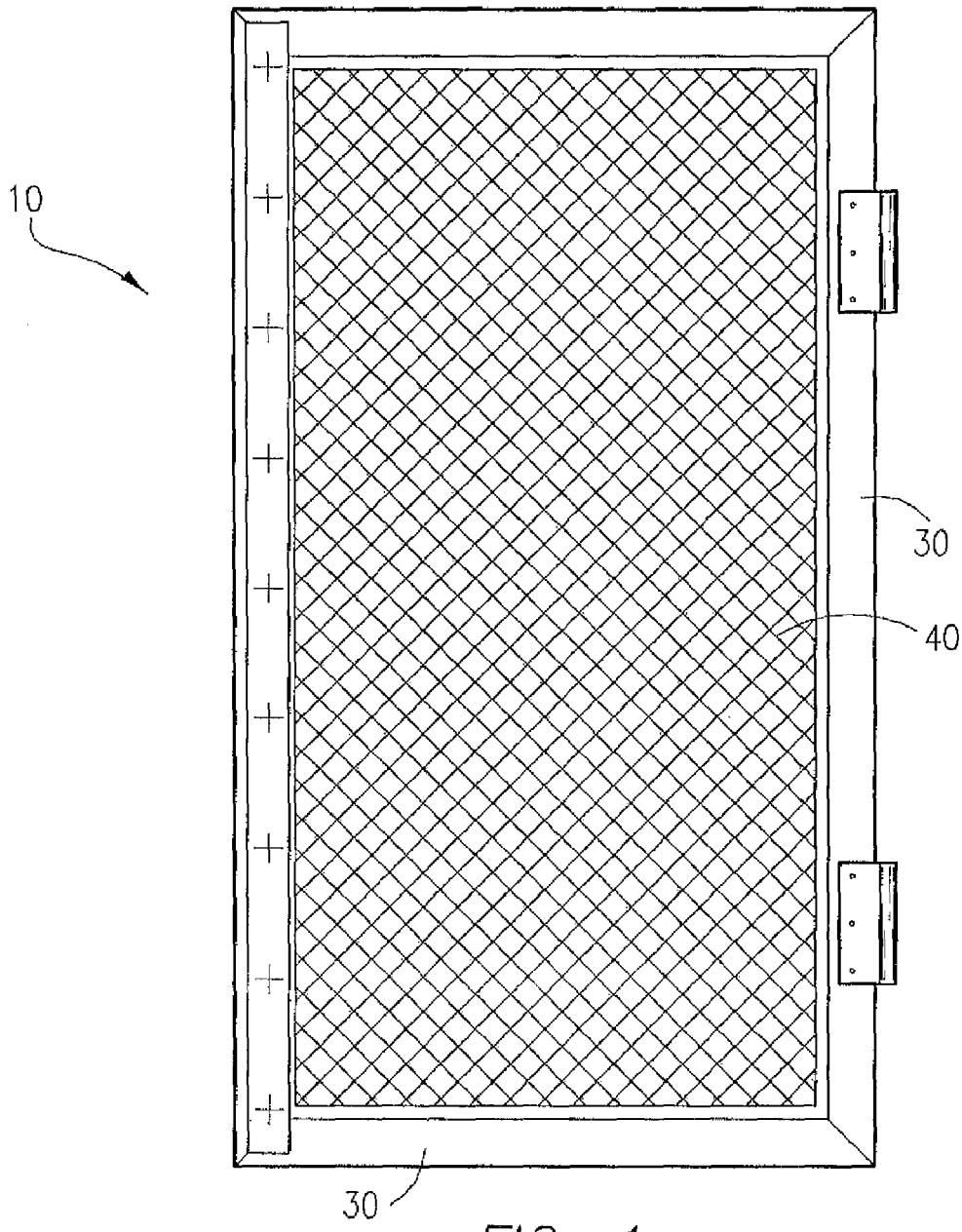
FIG. 1 is a front view of an openable section of a screen-type wind abatement system according to the present invention.
Figure 2:
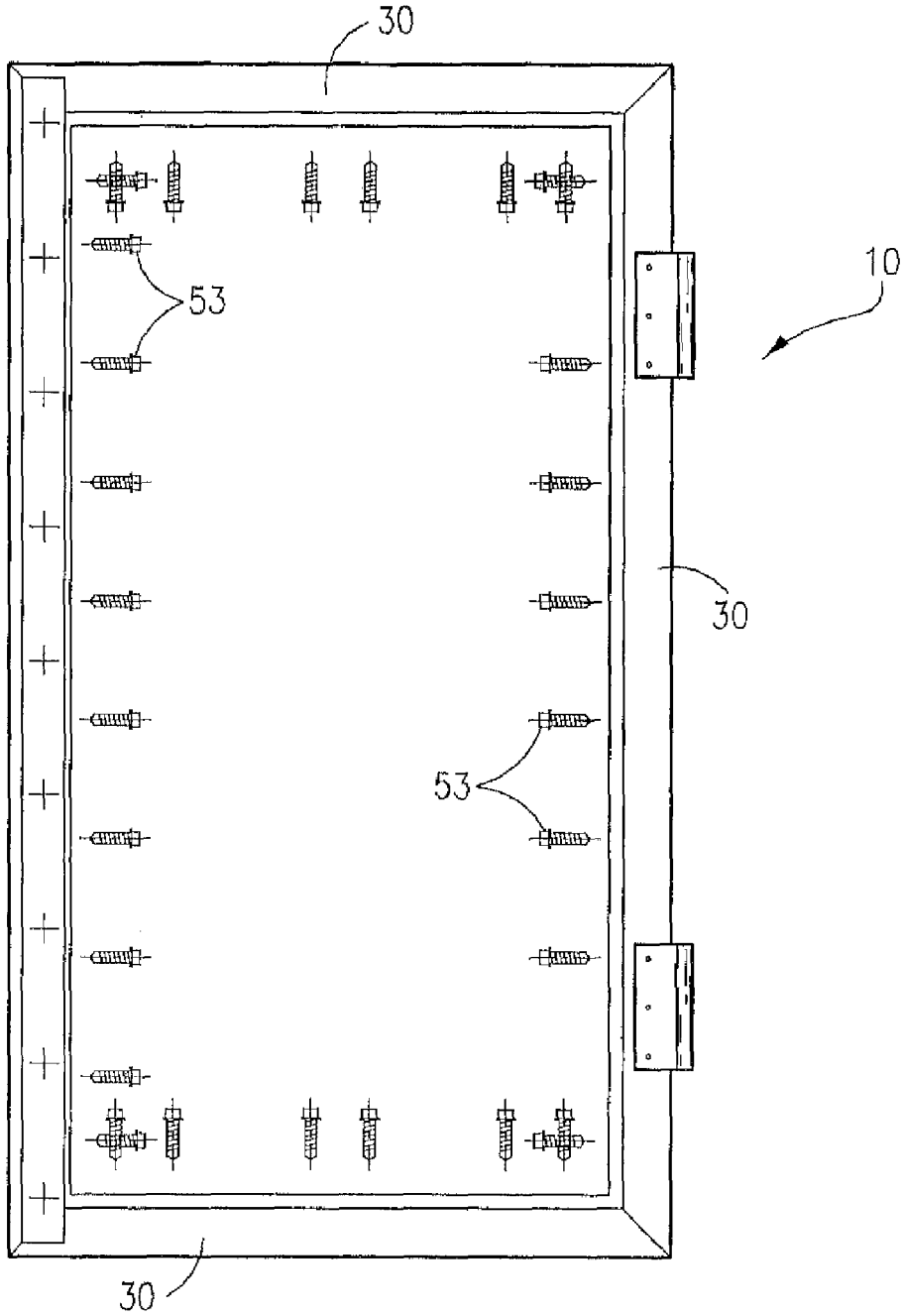
FIG. 2 is a front view thereof with the screen removed and the retainer fasteners shown in an exploded view.
Figures 3, 4:
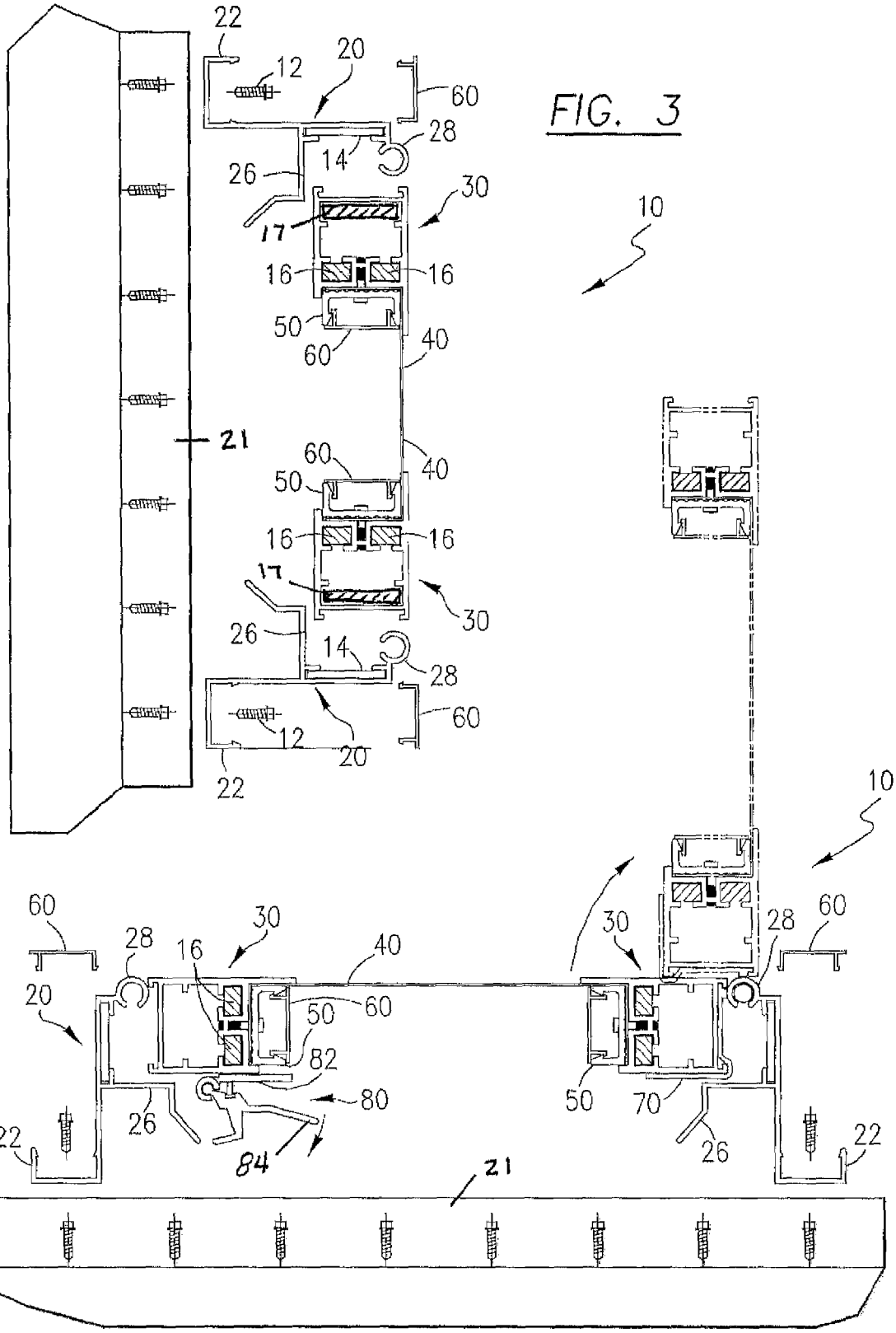
FIG. 3 is a side sectional view of the system in relation to the exterior of a structure.
FIG. 4 is a top sectional view of thereof showing the openable system in the closed configuration in normal view and the open configuration in phantom view.

With reference now to the drawings, FIGS. 1-4, depict an openable screen-type wind abatement system, generally referenced as 10, for covering openings such as windows and doors in accordance with the present invention. As best depicted in FIGS. 3 and 4, screen-type wind abatement system 10 includes a first frame member 20 anchored to the structure wall, or alternatively to a window or door frame, a second frame member 30 having a screen mounting portion for receiving an edge of a screen 40, a retainer member 50 for securing the screen, and a snap-on cover 60 for concealing fasteners. First frame member 20 may further be attached to an aluminum mounting frame, referenced as 21, that has previously been affixed to the structure. The system provides an openable mounting system whereby a heavy duty screen 40 is in covering relation with a window or door opening. The assembly is preferably fabricated of extruded aluminum of sufficient heavy-duty construction to resist high impact forces caused by hurricane force winds and accompanying flying debris.

First frame member 20 preferably typically includes four frame members, namely left, right, top and bottom, connected at right angle corner connections using key members 14 internally inserted therein to secure the first frame members by press fit connection. Each frame member 20 includes a generally U-shaped base 22 for receiving a fastener 12 to secure the frame member to a structure. In addition, each frame member 20 defines a key receiving slot 24, a projecting support arm 26, and an arcuate portion 28. Key receiving slot 24 receives an internal key member 14 to facilitate a secure corner-to-corner connection. Projecting arm 26 functions to provide a back-stop for engaging second frame member as discussed below.

Figure 5:
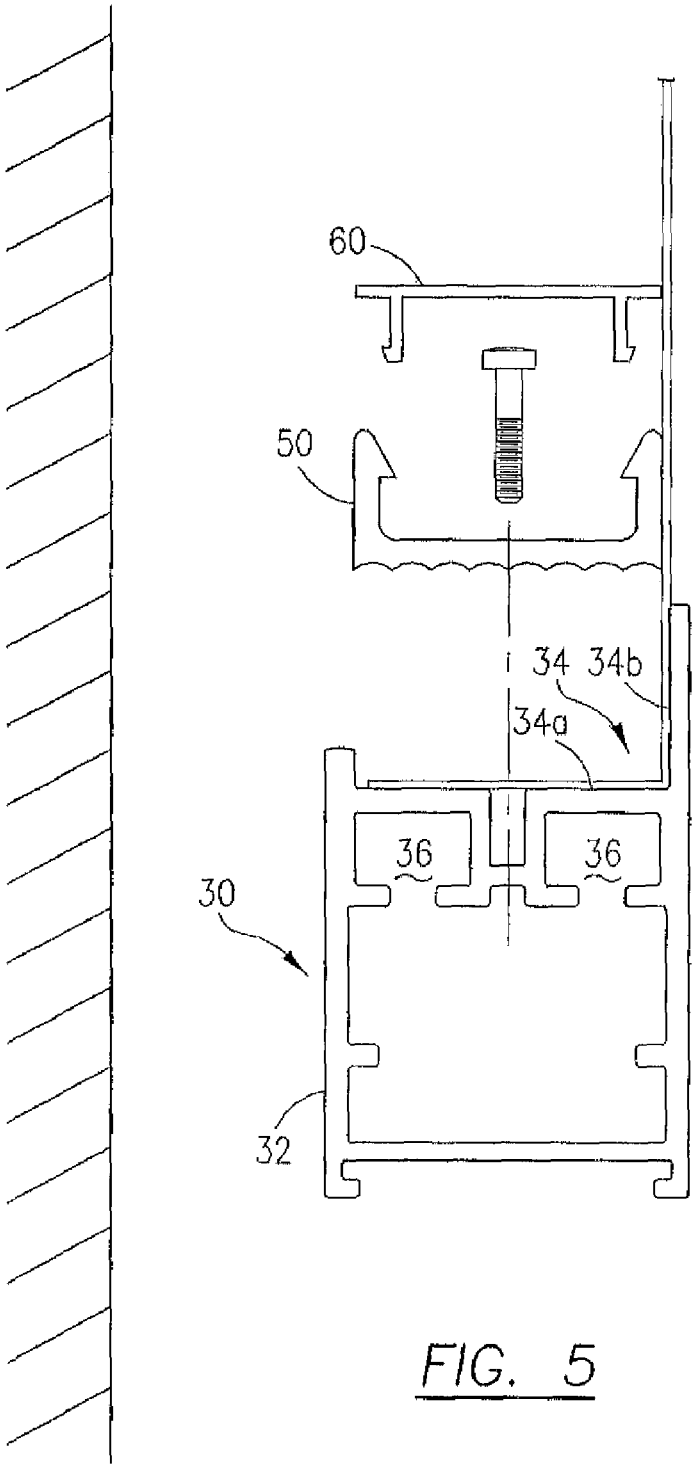
FIG. 5 is an exploded view of the screen retaining portions of the system.

As best seen in the sectional views of FIGS. 3-5, second frame member 30 preferably typically includes four frame members, namely left, right, top, and bottom, connected at right angle corner connections using key members 16 and 17 internally inserted therein to secure the second frame members in a generally square or rectangular configuration by press fit connection. Each frame member 30 includes a generally square main body 32 having a projecting arm defining a screen receiving external surface 34, and an internal key receiving slot 36. Screen receiving external surface 34 defines first and second surfaces, referenced as 34A and 34B, forming a right angled surface for receiving an edge portion of a screen 40 in abutting contact therewith as best depicted in FIGS. 3 and 4.

Screen 40 is anchored to frame member 30, and particularly to external surface 34 by a retainer 50 having a saw-tooth shaped bottom surface 52 for engaging and anchoring screen 40 in a sandwiched configuration disposed between retainer bottom surface 52 and surface 34A of frame member 30. Retainer 50 is fixedly connected to frame member 30 by a plurality of fasteners as shown in FIG. 2. The saw-tooth bottom surface 52 functions to securely anchor screen 40 such that the screen will withstand impact from windborne debris. As should be apparent, the shape retainer 50 and/or bottom surface 52 may be varied within the scope of the invention provided screen 40 is firmly anchored.

A screen assembly, is thus fabricated about an opening by first fabricating and affixing a mounting frame to the structure by connecting four first frame members 20, namely left, right, top and bottom members, and securing the members to form an integral frame by insertion of key members 14 received within internal slots 24. The integral frame formed by frame members 20 is then anchored to the wall of a structure in surrounding relation with an opening, such as a window or door, using suitable fasteners 12 connected to the structure through base 22. Alternatively, the frame may be affixed directly to the frame of a window or door. Next a wind screen assembly is fabricated to a suitable size for mating with frame members 20, by connecting four members 30, namely left, right, top and bottom, secured at corners by key members 16 received within slots 36. Key members 16 are preferably insertedly received within the mitered corner portions of members 30 and secured by peening from the exterior thereof. It has been found that connecting members 30 using key members 16 secured by peen punch provides an efficient and structurally secure connection. A screen 40 of suitable size is fitted within the frame assembly with the edges positioned in abutting engagement with surfaces 34A and 34B, whereafter the screen is secured by retainers 50 fixed by threaded fasteners 53.

The frame assembly is further adapted on one side with a hinge member 70 for pivotal connection to arcuate portion 28 of mounting frame member 20 as best depicted in FIG. 4. In addition, the opposite side is adapted with a snap-lock mechanism, generally referenced as 80, including a mounting plate 82 affixed to frame member 30, and a locking lever 84 pivotally connected thereto. Locking lever 84 operates by engaging projecting support arm 26 on a side frame member 20 to secure the frame and screen assembly in a closed position. Locking lever 84 may be manually disengaged to allow the frame and screen assembly to pivot outward and away from the structure to an open configuration.

Figure 12:
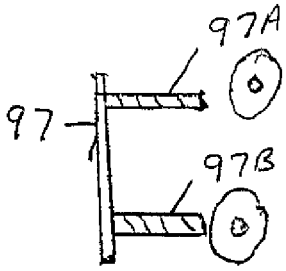
FIG. 12 depicts an alternate exterior end configuration for the embodiment depicted in FIG. 11.
Figure 11:
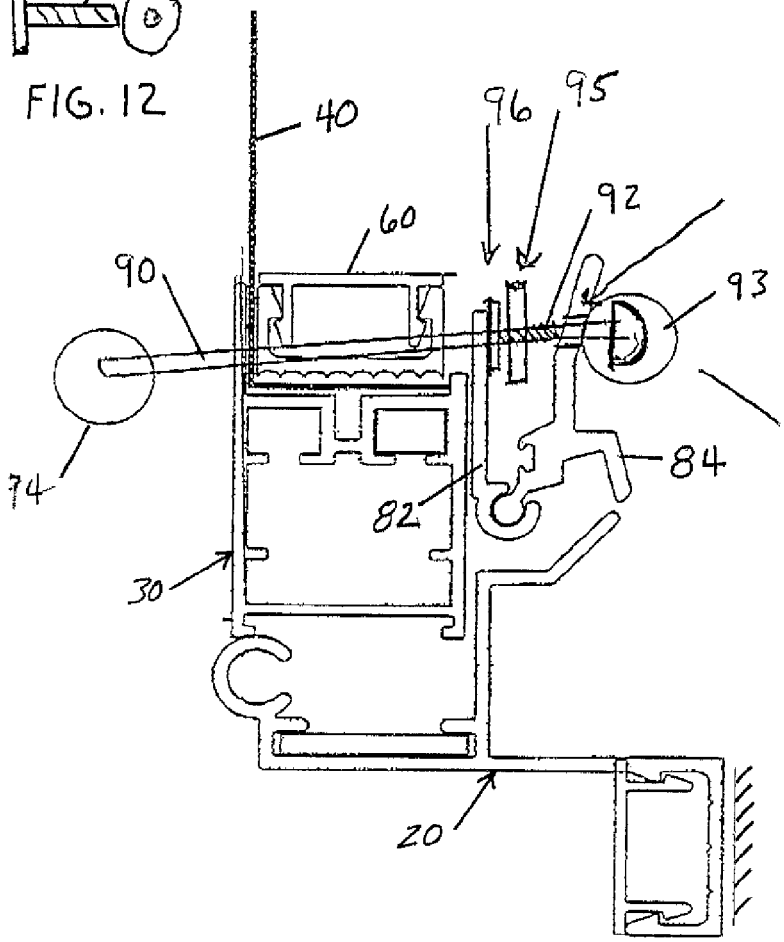
FIG. 11 depicts alternate embodiment openable system adapted for exterior un-latching of the openable screen frame.

FIG. 11 depicts an alternate embodiment wherein the frame assembly is further adapted with an a locking lever actuator 90 insertedly received, and movably disposed, within an aperture defined within frame member 30, mounting plate 82, and locking lever 84. Lever actuator 90 includes a first end 92 disposed on the interior side of frame 30 and a second end 94 disposed on the exterior side of frame 30. The first end 92 of lever actuator 90 is preferably threaded and includes an end cap 93 affixed to the end thereof, and a threaded nut 95 and washer 96 disposed between lever 84 and mounting plate 82 as best depicted in FIG. 11. As should be apparent, actuator 90 functions to allow for exterior actuation of locking lever 84. More particularly, locking lever 84 may be actuated from a locked configuration to an unlocked configuration (as seen in FIG. 11) from the exterior by grasping lever actuator 90 by the second end 94 and applying a force away from frame member 30 such that end cap 93 engages lever 84 and moves the lever to disengage arm 26 of frame member 20. In addition, threaded nut 95 functions to selectively disable lever actuator 90 by rotation thereof such that nut 95 and washer 96 engage mounting plate 82 thereby preventing movement of actuator 90 and particularly end cap 93 in a manner that would cause disengagement of lever 84 from the locked configuration. FIG. 12 depicts an alternate embodiment lever actuator 97 having multiple actuating legs, referenced as 97A and 97B.

Accordingly, the present invention provides a heavy-duty screen that can resist hurricane force winds and associated flying debris. For example, the screen of the present invention can resist the force of a two-by-four stud of lumber propelled at the screen at a force comparable to the force encountered under hurricane wind conditions. The screen of the present invention is designed to always be in position to cover and protect a window or door and eliminates the need for timely user intervention as discussed in the background section above. Still further, the present invention provides improved aesthetics for year round use and utilizes stainless steel to prevent corrosion that is typically encountered in coastal locations near an ocean where hurricanes commonly prevail. More particularly, screen 40 is preferably a powder coated stainless steel mesh screen having meshed wire in the range of 0.018"-0.064" diameter. An impact resistant screen in accordance with the present invention having 12"×12" stainless steel screen with mesh size of 0.028" and 0.032" has been tested an approved in accordance with the Large and Small Missile Impact Rating of Dade County, Fla. As should be apparent, the screen system also protects against insects, and vandals due to the strength. An additional benefit of using a stainless steel mesh that has been powder coated with a dark color (such as black) is a substantial reduction of approximately 95% of the solar load transmitted to a structure through a window opening thereby resulting in substantial energy savings. As a result, an impact resistant screen system in accordance with the present invention has been recognized for by the United States Department of Energy as reducing energy consumption through the reduction of solar transmission through windows.

Figure 6:
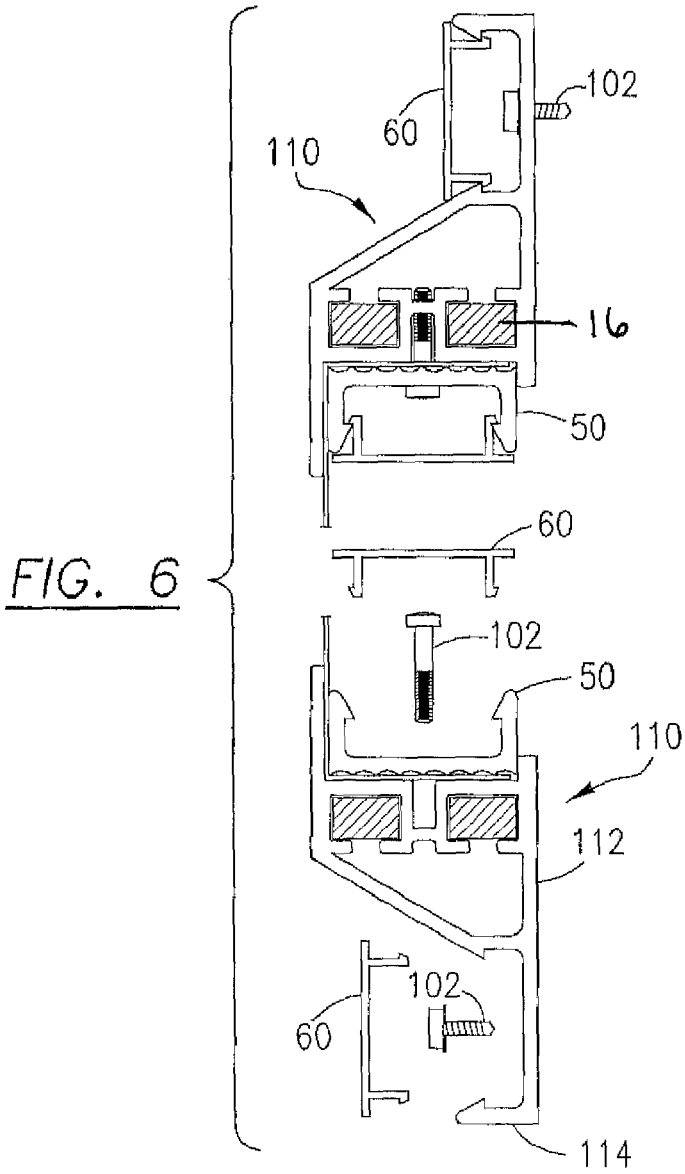
FIG. 6 is a side sectional view of the system adapted for direct anchoring to a structure in a non-openable installation.
Figure 7:
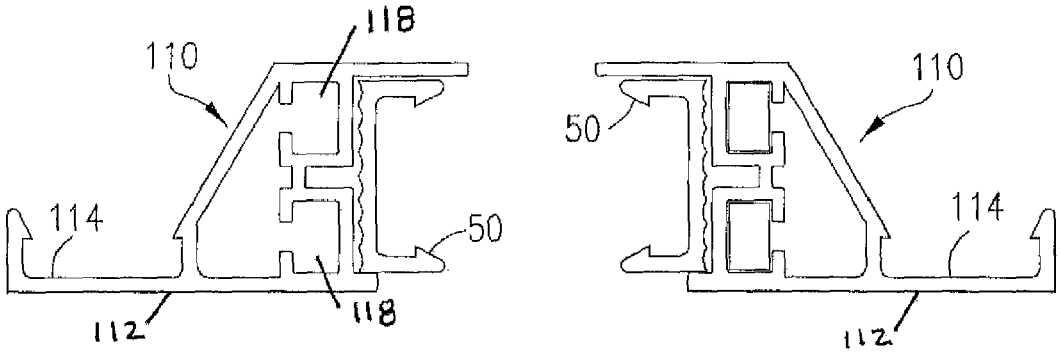
FIG. 7 is a top sectional view thereof.
Figure 8:
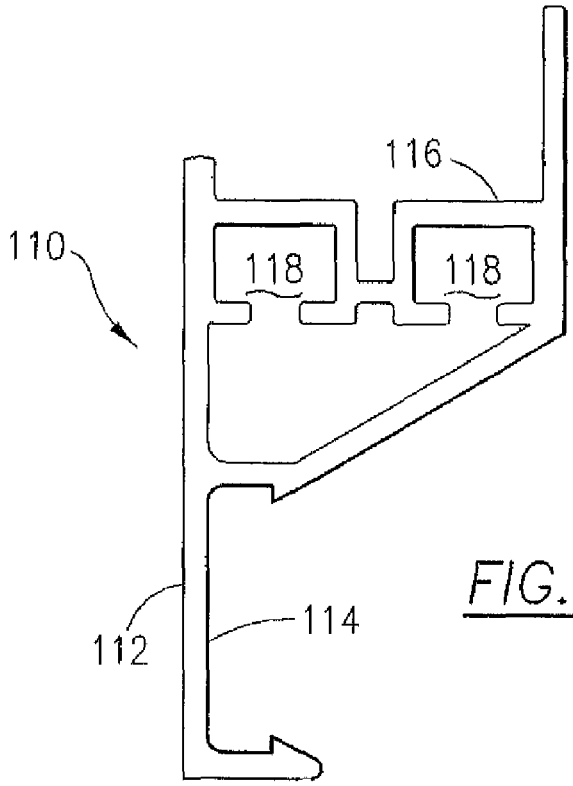
FIG. 8 is a sectional view of a frame member.
Figure 9:
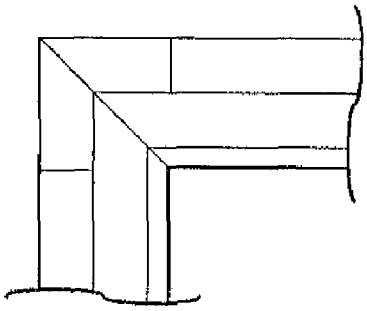
FIGS. 9 and 10 depict frame corner connections.
Figure 10:
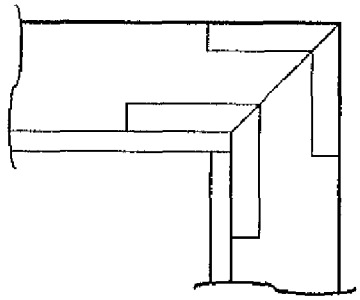

FIGS. 6-8 depict an alternate embodiment screen-type wind abatement system, generally referenced as 100, adapted for permanent/non-openable installation on a structure in surrounding relation with a window or door opening, or alternatively for affixation directly to the a window frame or door frame. Accordingly, the present invention specifically contemplates a window system having an impact resistant screen integrally fabricated therewith. Wind abatement system 100 is formed by connection of four frame members 110, namely left, right, top, and bottom, to form a generally square or rectangular frame assembly. Frame members 110 are affixed by insertion of key members 16 within internal slots 118 defined within each frame member. As should be apparent any suitable shaped frame assembly, however, is considered within the scope of the present invention. Each frame member 110 includes a generally planar rear surface 112, terminating in a generally U-shaped projecting channel 114 for receiving a threaded fastener 102 for anchoring the frame member to a wall, a previously installed mounting frame 21 (as seen in FIGS. 3 and 4) or another part of the structure. A snap-on cover 60 may be installed within the U-shaped channel to conceal the fastener heads. Frame member 110 further includes a right-angled surface 116 for receiving the edge of a screen 40 in abutting relation therewith. Screen 40 is secured by a retainer 50 affixed to frame member 110 in engagement with surface 116 by fasteners 102. A snap-on cap 60 is preferably affixed to retainer 50 to conceal the fasteners as best depicted in FIG. 6. As should be apparent, anchoring frame members 110 directly to the structure using fasteners. FIGS. 9 and 10 illustrate the use of keys to form corner connections for affixing frame members to form a frame assembly.

The present invention that provides an impact resistant screen-type storm barrier that is Dade County/Florida Building Protocol Approved, certified by the Florida Energy Office on behalf of the United States Department of Energy for reducing energy consumption, while enhancing security by providing a burglar resistant barrier.

The instant invention has been shown and described herein in what is considered to be the most practical and preferred embodiment. It is recognized, however, that departures may be made therefrom within the scope of the invention and that obvious modifications will occur to a person skilled in the art.

I claim:

1. An impact resistant screen system for attachment to a wall for protecting building windows and doors, said screen system comprising:

a frame falling generally within a plane and peripherally bounding an opening generally aligned with said plane;

said frame including a screen receiving surface disposed generally perpendicular to the plane of said opening, and a recessed fastener receiving channel defined along said screen receiving surface;

a screen disposed in covering relation with said opening, said screen having a main portion and a peripheral edge;

at least one screen retainer having a generally planar bottom surface with projecting teeth;

said screen peripheral edge sandwiched between said screen receiving surface and said retainer bottom surface with said screen peripheral edge disposed generally at a right angle relative to said screen main body and extending in sandwiched relation across substantially the entire length of said retainer bottom surface;

at least one fastener received within said channel and engaging said at least one retainer such that said retainer is driven toward said frame screen receiving surface in a direction linear and parallel to the plane of said opening as said fastener is tightened for drawing said screen tightly across said opening with said retainer projecting teeth engaging said screen peripheral edge disposed generally perpendicular to the plane of said opening.

2. An impact resistant screen system according to claim 1, further including a snap-on cover for connection to said retainer in concealing covering relation with said at least one fastener.

3. An impact resistant screen system according to claim 1, further including means for connecting said frame to a building.

4. An impact resistant screen system according to claim 3, wherein said means for connecting said frame to a building includes pivotally attaching said frame to the building by a hinged connection such that said frame is configurable from a closed configuration to an open configuration.

5. An impact resistant screen system according to claim 1, wherein said screen is stainless steel.

6. An impact resistant screen system according to claim 5, wherein said stainless steel screen is powder coated.

7. An impact resistant screen system according to claim 1, wherein said frame includes top, bottom, left, and right side frame members defining internal slots, said frame members connected together at adjoining ends thereof by key members received within said internal slots and secured by external peen punch to said frame so as to deform said frame to form a press fit with said key members.

8. An impact resistant screen system for attachment to a wall for protecting building windows and doors, said screen system comprising:

a frame falling generally within a plane and peripherally bounding an opening generally aligned with said plane;

said frame including a screen receiving surface disposed generally perpendicular to the plane of said opening, said screen receiving surface defining a fastener receiving channel;

a screen disposed in covering relation with said opening, said screen having a main portion and a peripheral edge;

at least one screen retainer having a planar bottom surface with projecting teeth;

said screen peripheral edge sandwiched between said screen receiving surface and said retainer bottom surface with said screen peripheral edge disposed generally at a right angle relative to said screen main body and extending in sandwiched relation across substantially the entire length of said retainer bottom surface;

at least one fastener engaging said at least one retainer such that said retainer is driven toward said frame screen receiving surface in a direction linear and parallel to the plane of said opening as said fastener is received within said frame channel and tightened for drawing said screen tightly across said opening with said retainer projecting teeth engaging said screen peripheral edge disposed generally perpendicular to the plane of said opening; and a cover in removable snap-fit engagement with said retainer concealing said at least one fastener.

* * * * *